US008864529B2

(12) United States Patent
Chung et al.

(10) Patent No.: US 8,864,529 B2
(45) Date of Patent: Oct. 21, 2014

(54) USB PLUG CONNECTOR STRUCTURE

(71) Applicant: Kuang Ying Computer Equipment Co., Ltd., New Taipei (TW)

(72) Inventors: Hsuan-Ho Chung, New Taipei (TW); Yu-Hung Lin, New Taipei (TW); Chih-Ming Hsu, New Taipei (TW)

(73) Assignee: Kuang Ying Computer Equipment Co., Ltd., New Taipei (TW)

( * ) Notice: Subject to any disclaimer, the term of this patent is extended or adjusted under 35 U.S.C. 154(b) by 0 days.

(21) Appl. No.: 13/783,404

(22) Filed: Mar. 4, 2013

(65) Prior Publication Data

US 2014/0080332 A1 Mar. 20, 2014

(30) Foreign Application Priority Data

Sep. 14, 2012 (TW) ..... 101217836 U

(51) Int. Cl.
*H01R 24/00* (2011.01)
*H01R 13/648* (2006.01)

(52) U.S. Cl.
CPC ..... *H01R 13/648* (2013.01); *Y10S 439/946* (2013.01)
USPC ..... 439/660; 439/946

(58) Field of Classification Search
CPC ..... H01R 23/7073; H01R 13/025
USPC ..... 439/95, 607.31–607.4, 660, 946
See application file for complete search history.

(56) References Cited

U.S. PATENT DOCUMENTS

| | | | | |
|---|---|---|---|---|
| 7,534,141 | B1 * | 5/2009 | Wu | 439/607.01 |
| 8,083,546 | B2 * | 12/2011 | Lee | 439/607.02 |
| 8,303,315 | B2 * | 11/2012 | Lee | 439/79 |
| 8,398,438 | B2 * | 3/2013 | Zhang et al. | 439/660 |
| 8,641,456 | B2 * | 2/2014 | Wu | 439/676 |
| 8,662,936 | B2 * | 3/2014 | Chung et al. | 439/660 |

* cited by examiner

*Primary Examiner* — Tulsidas Patel
*Assistant Examiner* — Phuongchi T Nguyen
(74) *Attorney, Agent, or Firm* — Leong C. Lei

(57) ABSTRACT

A USB plug connector structure can use the same set of terminals to apply on different USB connector patterns, such as plate edge connector or wire edge connector, through the design of various soldering portions and base portions being positioned on the same plane. Furthermore, the common mode signals generated from first and second differential signal transmission conductor sets can be restrained by means of first and second grounding base portions of a grounding transmission conductor surrounding first and second differential signal transmission conduct sets. In addition, crosstalk interference generated from the first and second differential signal transmission conductor sets to a signal transmission conductor set can be similarly isolated through the first and second grounding base portions. Furthermore, a bended angle of each bended portion ranges from 120 to 150 degrees, thereby guide scattered radio frequency interference.

15 Claims, 10 Drawing Sheets

USB PLUG CONNECTOR STRUCTURE

(a) TECHNICAL FIELD OF THE INVENTION

The present invention relates to a USB plug connector structure, and more particularly to a USB plug connector structure, which saves costs, allows the manufacturing speed to be increased, and can configure various different specifications of USB connector structures only through one set or one pattern type of terminals.

(b) DESCRIPTION OF THE PRIOR ART

The applications of connectors range broadly, and the fields they touch include USB connectors and etc. USB connectors are improved unceasingly, and the transmission speed thereof is increased in the meantime.

With respect to the current general USB connectors, the soldering feet thereof are always changed depending on substrates they are coupled to, for example, SMT, DIP, plate edge, wire edge, sink board, top mount or reverse mount, causing the bended angle or manner of soldering feet to be changed depending on boards they are coupled to, and manufacturers to make different soldering foot patterns to match different types of USB connectors; the deficiencies undoubtedly increase the production cost and time, the worse is that it is unable to share multiple different types of connectors with one single conducting terminal specification.

SUMMARY OF THE INVENTION

To improve the above deficiencies, save production cost and increase the manufacturing speed, the present invention proposes a multiple different specifications of USB plug connector structures that can be configured with only one set or one pattern type of terminals.

The main object of the present invention is to provide a USB plug connector structure, allowing the present invention to use the same set of terminals to apply on different USB connector patterns through the design of various soldering portions and various base portions being positioned on the same plane.

Another object of the present invention is to provide a USB plug connector structure, capable of restraining the common mode signals generated from first, second differential signal transmission conductor sets by means of first, second grounding base portions of a grounding transmission conductor surrounding first, second differential signal transmission conductor sets.

Still another object of the present invention is to provide a USE plug connector structure, isolating the crosstalk interference generated from the first, second differential signal transmission conductor sets to a signal transmission conductor set through first, second grounding base portions.

To achieve the objects mentioned above, the present invention proposes a USB plug connector structure, including a power supply transmission conductor and grounding transmission conductor, where the grounding transmission conductor defines a plate grounding contact portion, first, second grounding base portions and first, second grounding soldering portions, and the grounding transmission conductor is arranged in groups with the power supply transmission conductor and electronic module to form a grounding circuit to surround a first differential signal transmission conductor set, signal transmission conductor and second differential signal transmission conductor sets, thereby restraining effectively the common mode signals generated from the first, second differential signal transmission conductor sets by allowing the first, second differential signal transmission conductor sets to be surrounded, and isolating the crosstalk interference generated from the first, second differential signal transmission conductor sets to the signal transmission conductor set. Furthermore, the grounding transmission conductor includes a first grounding base portion and a first grounding soldering portion extended from the first grounding base portion. The first differential signal transmission conductor set disposed between the two first grounding base portions includes a first differential signal base portion set and a first differential signal soldering portion set extended from the first differential signal base portion set. Furthermore, the signal transmission conductor set disposed between the first ground base portion and second grounding base portion includes a signal base portion set and a signal soldering portion set extended from the signal base portion set. Furthermore, the second differential signal transmission conductor set disposed on the side of the second grounding base portion deviating from the signal transmission conductor set includes a second differential signal base portion set and a second differential signal soldering portion set extended from the second differential signal base portion set. Furthermore, the power supply transmission conductor disposed on the side of the second differential signal transmission conductor set deviating from the second grounding base portion includes a power supply base portion and a power supply soldering portion extended from the power supply base portion, wherein the power supply soldering portion, second differential signal soldering portion set, second grounding soldering portion, signal soldering portion set, first grounding soldering portion and first differential signal soldering portion sets are arranged transversely parallel to one another on the same plane, and the power supply base portion, second differential signal base portion set, second grounding base portion, signal base portion set, first grounding base portion and first differential signal base portion set are similarly arranged transversely parallel to one another on the same plane, thereby achieving the above-mentioned advantages.

DETAILED DESCRIPTION OF THE PREFERRED EMBODIMENTS

Figure 1:
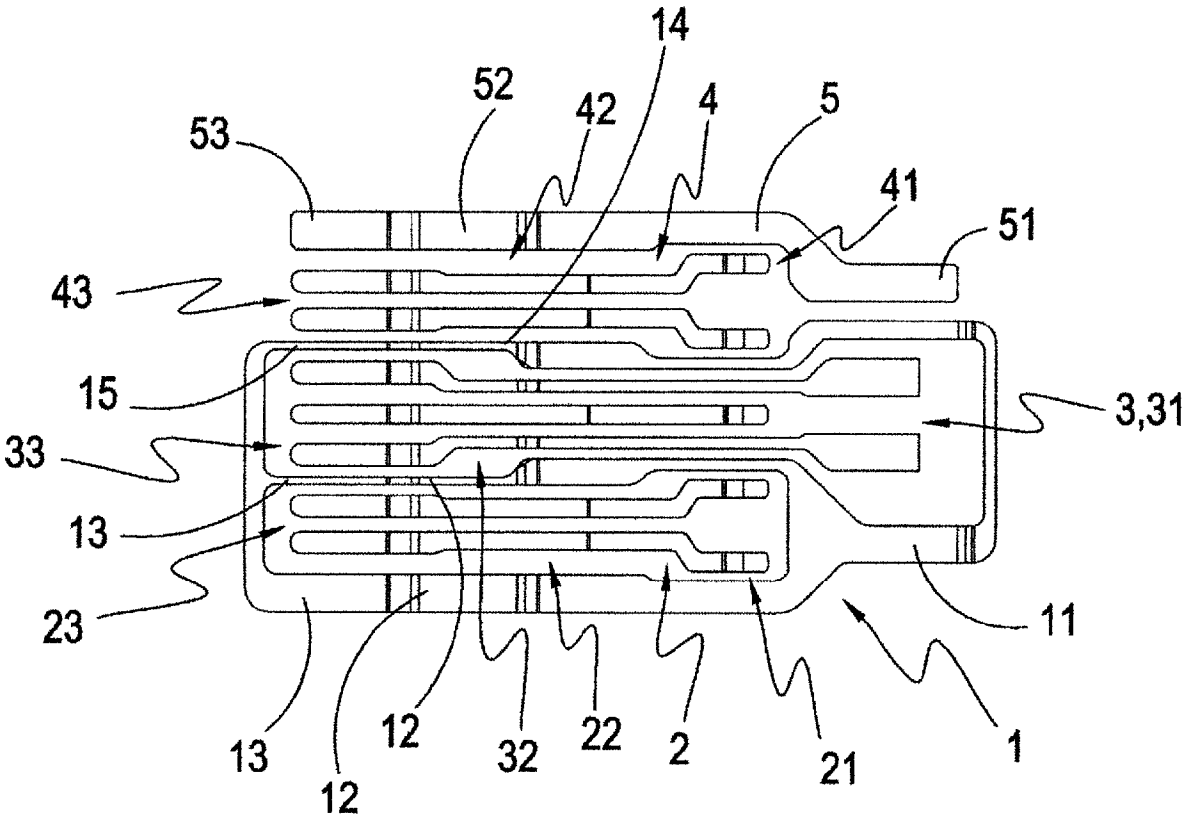
FIG. 1 is a plan view of a terminal set of the present invention.
Figure 2:
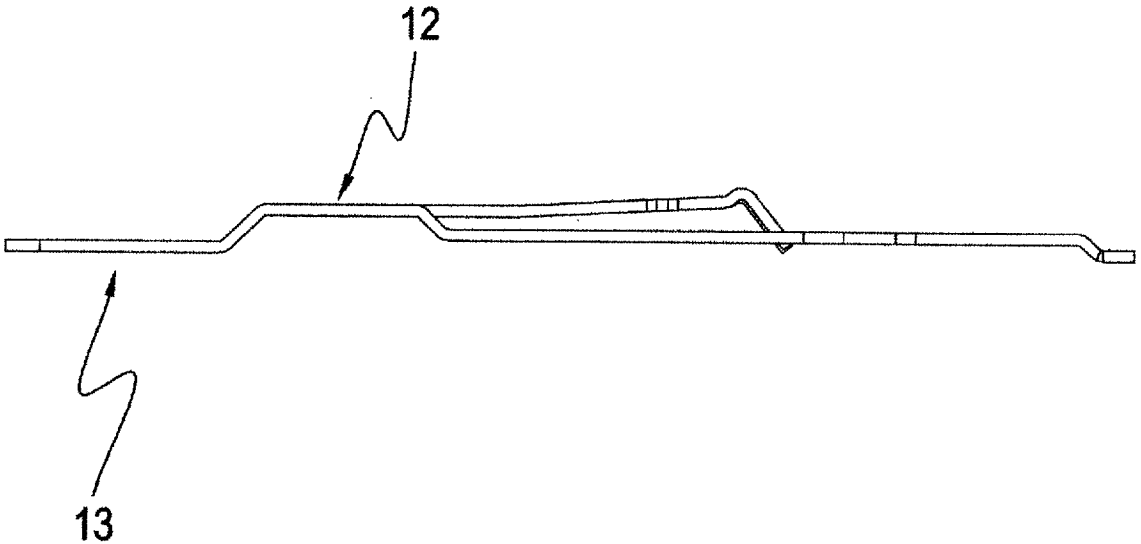
FIG. 2 is a side view of a terminal set of the present invention.

Referring to FIGS. 1 and 2, which respectively are a plan view and side view of a terminal set of the present invention, a terminal set of the present invention includes a grounding transmission conductor 1, first differential signal transmission conductor set 2, signal transmission conductor set 3, second differential signal transmission set 4 and power source transmission conductor set 5.

The grounding transmission conductor 1 defines a plate grounding contact portion 11 at the front end thereof, the plate grounding contact portion 11 is diverged rearward and respectively extend with a first grounding base portion 12, and a first grounding soldering portion 13 extended respectively from each first grounding base portion 12, the plate grounding contact portion 11 is further bended in a direction deviating from the first grounding base portion 12 to extend to form a second grounding base portion 14 parallel to the first grounding base portion 12, and the second grounding base portion 14 is extended to define a second grounding soldering portion 15 in connection with the first grounding soldering portion 13.

The first differential signal transmission conductor set 2 is disposed between the two first grounding base portions 12, and the first differential signal transmission conductor set 2 defines a first elastic differential signal contact portion set 21 at the front end thereof. Furthermore, the first elastic differential signal contact portion set 21 is extended rearward with a first differential signal base portion set 22 and a first differential signal soldering portion set 23 extended from the first differential signal base portion set 22.

The signal transmission conductor set 3 is disposed between the first grounding base portion 12 and the second grounding base portion 14, and the signal transmission conductor set 3 defined a plate signal contact portion set 31 at the front end thereof. Furthermore, the plate signal contact portion set 31 is extended rearward with a signal base portion set 32 and a signal soldering portion set 33 extended from the signal base portion set 32.

The second differential signal transmission conductor 4 is disposed on the side of the second grounding base portion 14 deviating from the signal transmission conductor set 3, and the second differential signal transmission conductor set 4 defines a second elastic differential signal contact portion set 41 at the front end thereof. Furthermore, the second elastic differential signal contact portion set 41 is extended rearward with a second differential signal base portion set 42 and a second differential signal soldering portion set 43 extended from the second differential signal base portion set 42.

The power supply transmission conductor 5 is disposed on the side of the second differential signal transmission conductor 4 deviating from the second grounding base portion 14, and the front end thereof defines a plate power source contact portion 51. Furthermore, the plate power source contact portion 51 is extended rearward with a power supply base portion 52 and a power supply soldering portion 53 extended from the power supply base portion 52.

In the embodiment, it is characterized in that the above-mentioned power supply soldering portion 53, second differential signal soldering portion set 43, second soldering portion 15, signal soldering portion set 33, first grounding soldering portion 13 and first differential signal soldering portion set 23 are parallel transversely to one another to be positioned on the same plane (i.e. the same horizontal plane), and the power base portion 53, second differential signal base portion set 42, second grounding base portion 14, signal base portion set 32, first grounding base portion 12 and first differential signal base portion set 22 are arranged transversely similarly and parallel to one another on the same plane.

Figure 3:
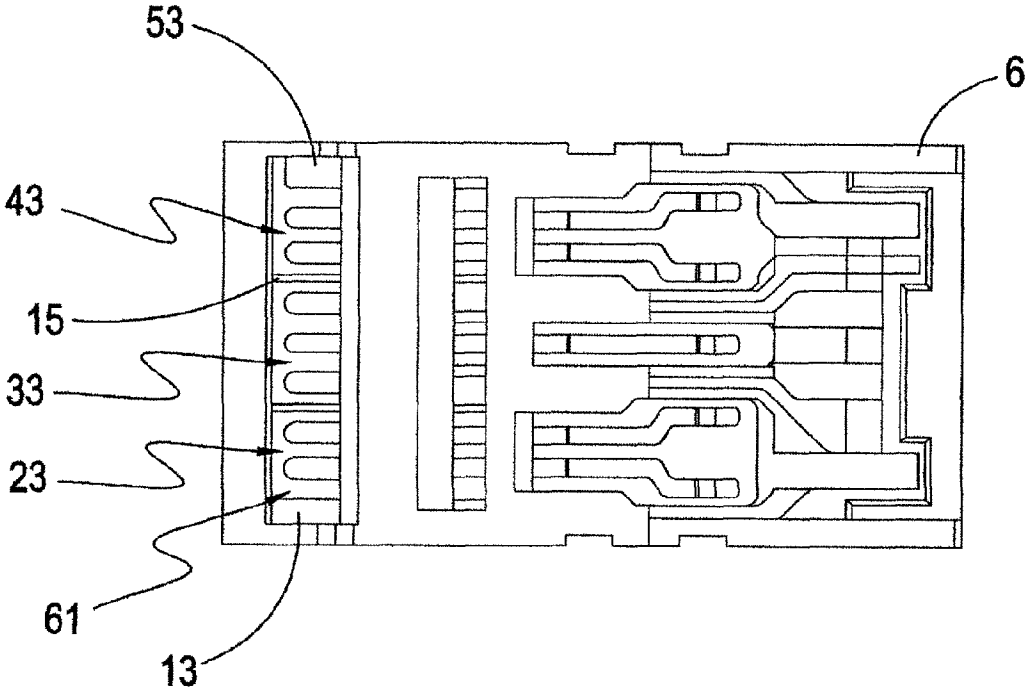
FIG. 3 is a schematic view of a terminal set coupled to an insulating colloid of the present invention.

Furthermore, with respect to the installment of an insulating colloid 6, referring to FIGS. 1 and 3, which respectively are a plan view of a terminal set of the present invention and schematic view of a terminal set coupled to an insulating colloid, the grounding transmission conductor 1, first differential signal transmission conductor set 2, signal transmission conductor set 3, second differential signal transmission set 4 and power source transmission conductor set 5 of the terminal set are coupled to an insulating colloid 6, where the insulating colloid 6 has a hollow portion 61. The hollow portion 61 allows the first grounding soldering portion 13, second grounding soldering portion 15, first differential signal soldering portion set 23, signal soldering portion set 33, second differential signal soldering portion set 43 and power supply soldering portion 53 to be exposed to the outside.

Figure 4:
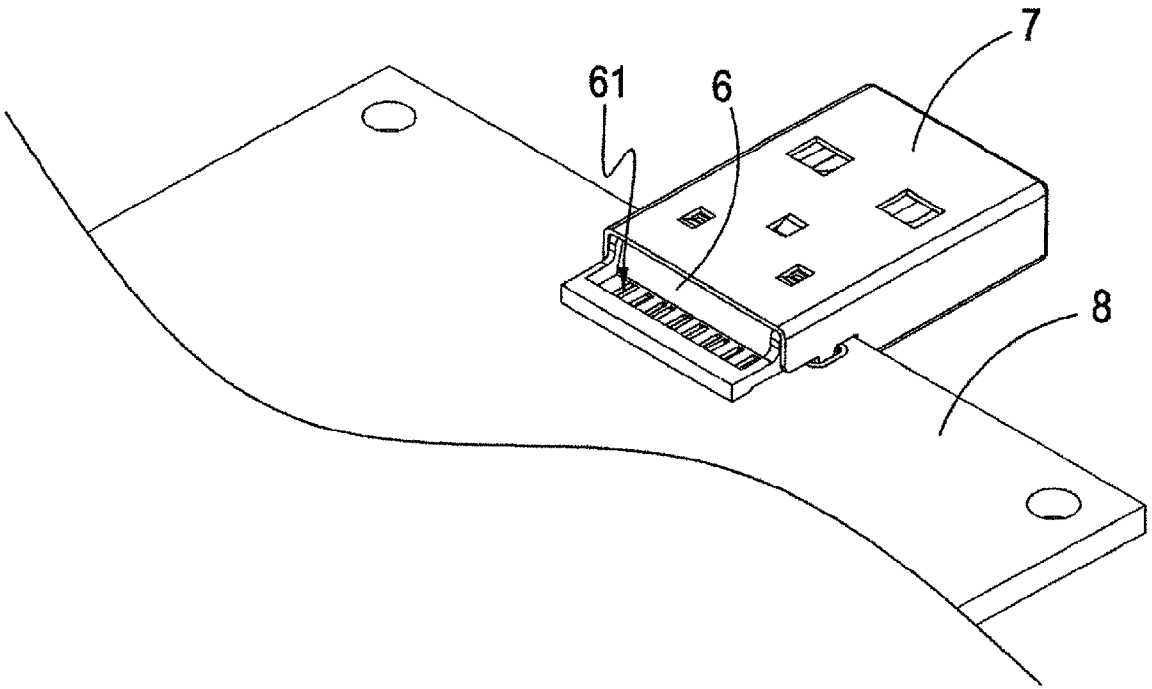
FIG. 4 is a schematic view of a pattern of shielding housing assembly of the present invention.

Furthermore, with respect to the insulating colloid 6 coupled to a shielding housing 7, referring to FIGS. 1 and 4, which respectively are a plan view of a terminal set of the present invention and schematic view of a pattern of shielding housing assembly, the insulating colloid 6 is almost covered completely with a shielding housing 7 except the hollow portion 61, and the first grounding soldering portion 13, second grounding soldering portion 15, first differential signal soldering portion set 23, signal soldering portion set 33, second differential signal soldering portion set 43 and the power supply soldering portion 53 are all soldered on a circuit board 8 that is not be covered by the shielding housing 7; it is clear from the figures that the present invention may be configured on a board edge connector pattern.

Figure 5:
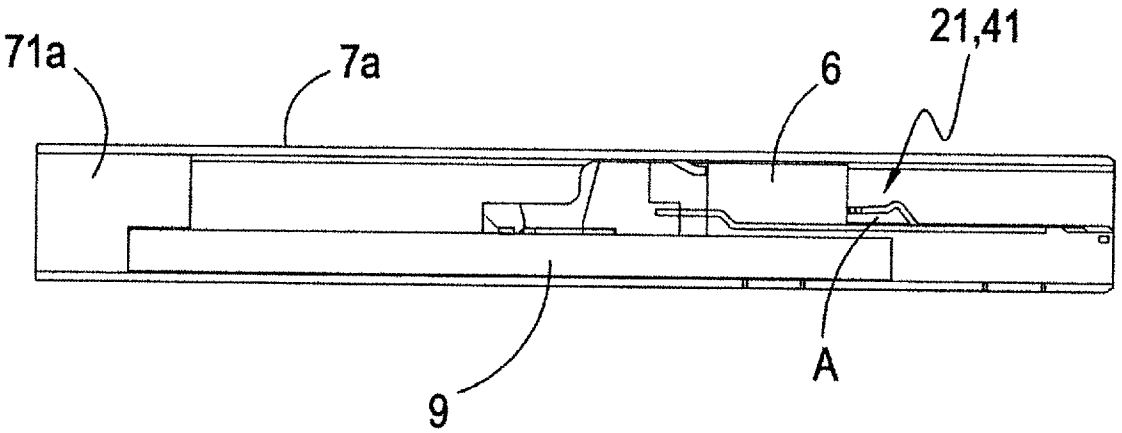
FIG. 5 is a schematic view of another pattern of shielding housing assembly of the present invention.

Furthermore, taking the above-mentioned insulating colloid 6 as an example, referring to FIGS. 1 and 5, which respectively are a plan view of a terminal set of the present invention and schematic view of another pattern of shielding housing assembly, not only the way of a shielding housing 7*a* covering the insulating colloid 6 is almost the same as the above-mentioned pattern, but the covering range further includes the hollow portion (not shown in the figure), and similarly, the first grounding soldering portion 13, second grounding soldering portion 15, first differential signal soldering portion set 23, signal soldering portion set 33, second differential signal soldering portion set 43 and power surly soldering portion 53 may all be soldered on an electronic module 9, and the electronic module 9 is covered by the shielding housing 7*a*; it is clear from the figures that may be configured on a chip on board (COB) connector pattern. Furthermore, an accepting space for mounting the electronic module 9 is formed at the bottom of the insulating colloid 6(the accepting space is not shown, because it is already occupied by the electronic module 9 in the figure), and at least one stopping portion 63 for limiting the position of the electronic module 9 is disposed thereon. More importantly, a distance A exists between the first elastic differential signal contact portion set 21, second elastic differential signal contact portion set 41 and the electronic module 9, thereby preventing the first elastic differential signal contact portion set 21 and second elastic differential signal contact portion set 41 from touching the electronic module 9 when they are touched and pressed down. In addition, a rear cover 71*a* is disposed on one end of the shielding housing 7*a*.

Figure 6:
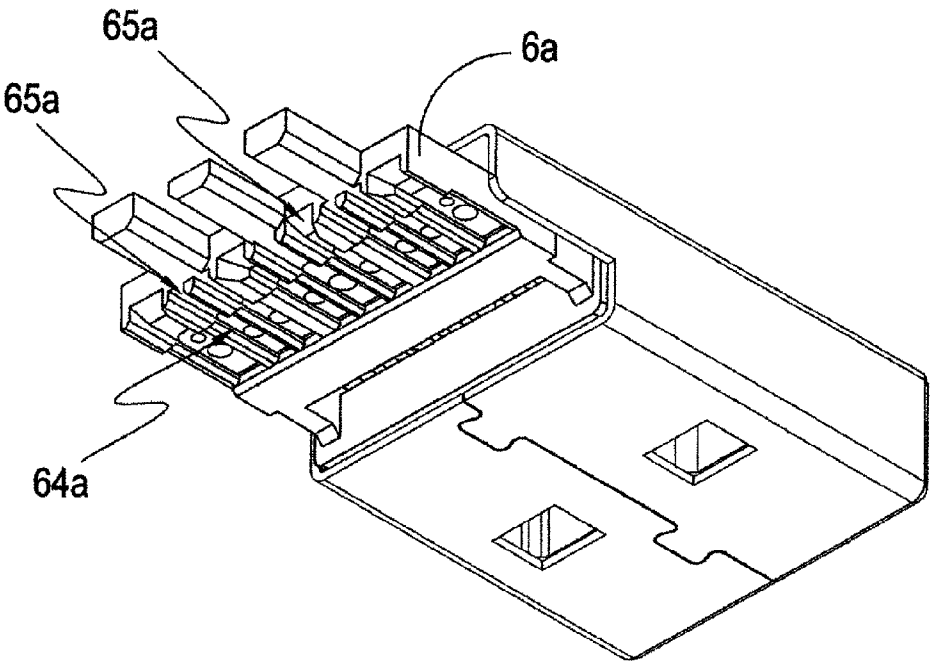
FIG. 6 is a schematic view of a pattern of insulating colloid assembly of the present invention.

Referring to FIGS. 1 and 6, which respectively are a plan view of a terminal set of the present invention and schematic view of a pattern of insulating colloid assembly, the grounding transmission conductor 1, first differential signal transmission conductor set 2, signal transmission conductor set 3, second differential signal transmission conductor set 4 and power supply transmission conductor 5 are respectively coupled to an insulating colloid 6*a*, which is formed into a plurality of groove portions 64*a* and a plurality of position limiting grooves 65*a*. Each groove portion 64*a* respectively allows the first grounding soldering portion 13, second grounding soldering portion 15, first differential signal soldering portion set 23, signal soldering portion set 33, second differential signal soldering portion set 43 and power supply soldering portion 53 to be exposed to the outside. Whereby, it is stressed in the embodiment that the various soldering portions can be exposed to the outside by means of "fence" formed by groove portions 64*a* besides by means of the above-mentioned hollow portion adopted on the insulating colloid shown in FIG. 5. Furthermore, each positioning limiting groove 65*a* is adapted to limit the position of at least one transmission wire, and each transmission wire is respectively electrically in connection with the first grounding soldering portion 13, second grounding soldering portion 15, first differential signal soldering portion set 23, second differential signal soldering portion set 43, signal soldering portion set 33 and power soldering portion 53. Therefore, the transmission wires can be arranged conveniently through the design of the positioning groove 65*a*, allowing the transmission wire to be neater and tidier without entangling together.

Figure 7:
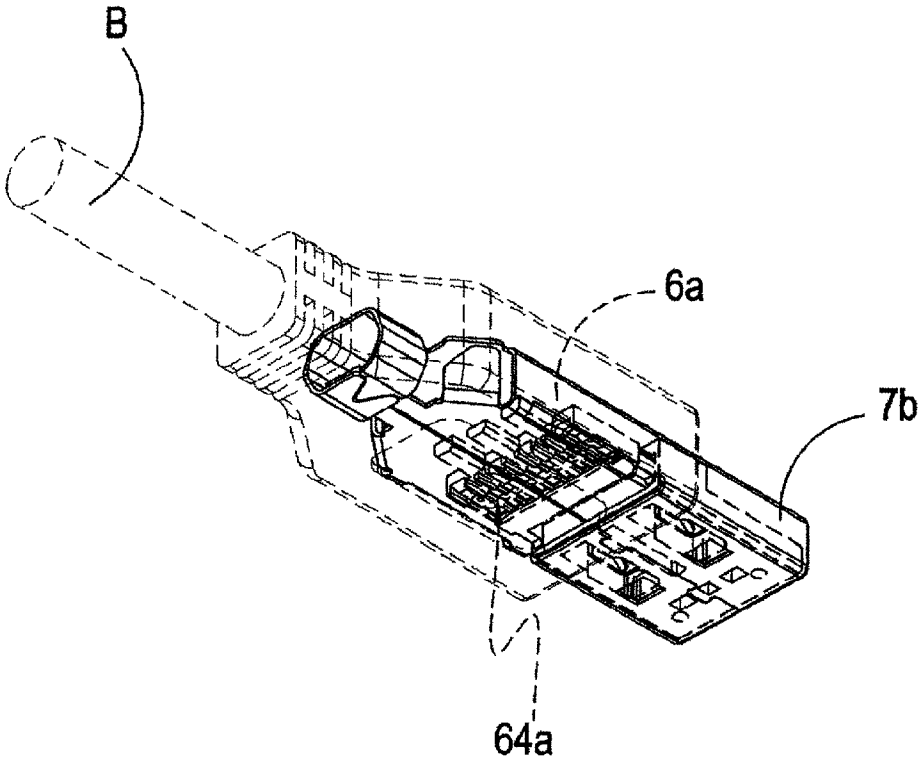
FIG. 7 is a schematic view of still another pattern of shielding housing assembly of the present invention.

With respect to the above-mentioned insulating colloid, referring to FIGS. 1 and 7, which respectively are a plan view of a terminal set of the present invention and schematic view of still another pattern of a shielding housing assembly, the insulating colloid 6*a* is covered with a shielding housing 7*b* in a range including the groove portion 64*a*, and the first grounding soldering portion 13, second grounding soldering portion 15, first differential signal soldering portion set 23, signal soldering portion set 33, second differential signal soldering portion set 43 and power supply soldering portion 53 are respectively in electric connection with a transmission wire B, namely, the described herein is an exemplary embodiment applied on a wire edge connector pattern.

Figure 8:
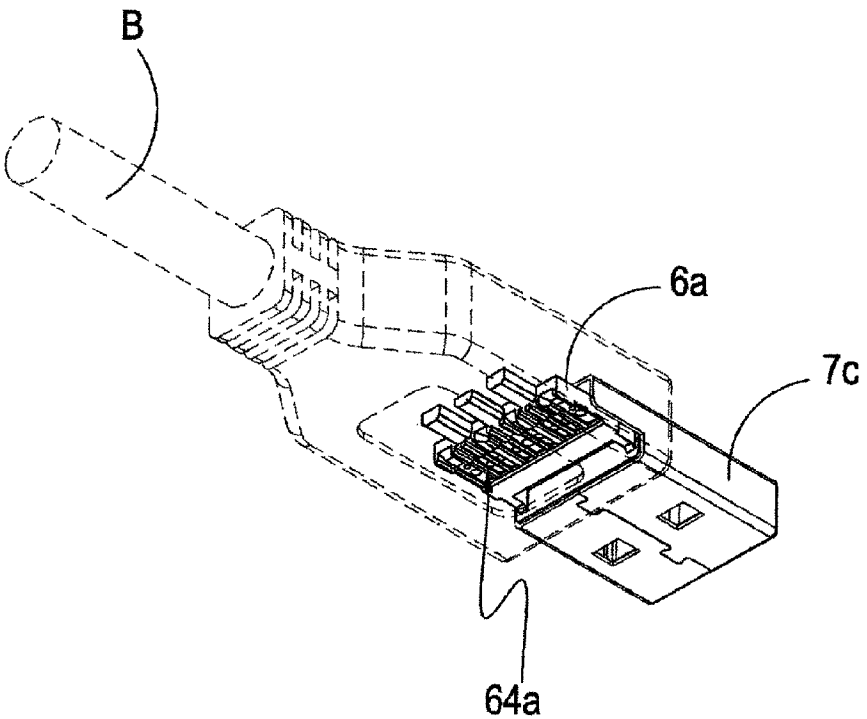
FIG. 8 is a schematic view of yet another pattern of shielding housing assembly of the present invention.

Referring to FIGS. 1 and 8, which respectively are a plan view of a terminal set of the present invention and schematic view of yet another pattern of shielding housing assembly, the insulating colloid 6*a* is covered with a shielding housing 7*c* in a range not including the groove portion 64*a*, and the first grounding soldering portion 13, second grounding soldering portion 15, first differential signal soldering portion set 23, signal soldering portion set 33, second differential signal soldering portion set 43 and power supply soldering portion 53 are respectively in electric connection with a transmission wire B, namely, there is another different covering method other than the shielding housing covering method mentioned above.

Figure 9:
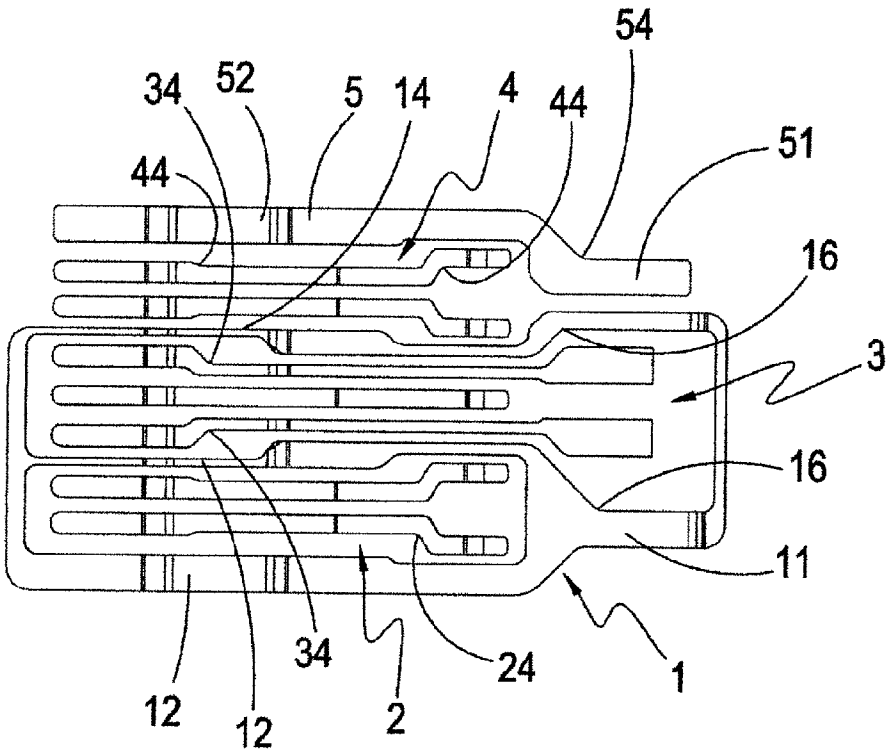
FIG. 9 is a plan view of another preferred embodiment of the present invention.
Figure 10:
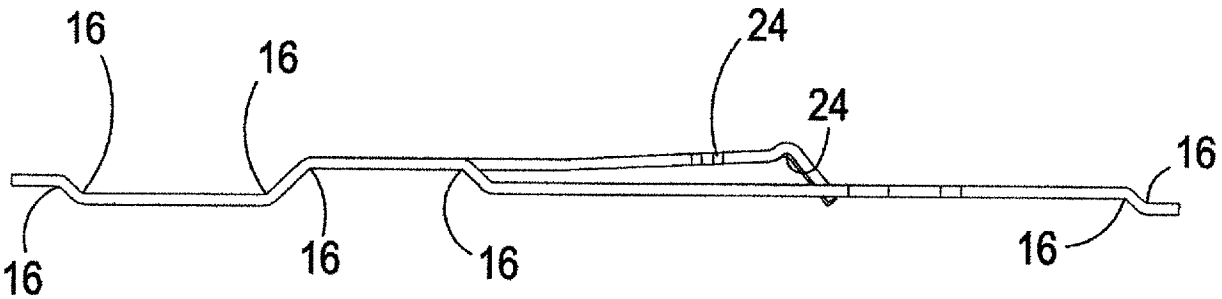
FIG. 10 is a side view of another preferred embodiment of the present invention.

Referring to FIGS. 9 and 10, which respectively are a plan view and side view of another preferred embodiment of the present invention, a terminal set mainly includes a grounding transmission conductor 1, first differential signal transmission conductor set 2, signal transmission conductor set 3, second differential signal transmission set 4 and power source transmission conductor set 5.

The grounding transmission conductor 1, adapted to define a plate grounding contact portion 11 at the front end thereof. The plate grounding contact portion 11 is diverged rearward and extended with a respect first grounding base portions 12, and the first grounding base portions 12 can isolate the crosstalk interference generated from the first differential signal transmission conductor set 2 to the signal transmission conductor set 3 and also restrain the common mode (CM) signal interference generated from the first differential signal transmission conductor set 2 in the meantime. Furthermore, the plate grounding contact portion 11 is bended in a direction deviating from the first grounding base portion 12 and extended to form a second grounding base portion 14 parallel to the first grounding base portion 12, which can isolate the crosstalk interference generated from the second differential signal transmission conductor set 4 to the signal transmission conductor set 3, in addition, the grounding transmission conductor 1 has a plurality of grounding bended portions 16.

The first differential signal transmission conductor set 2 is disposed between the two first grounding base portions 12, and has a plurality of first differential signal bended portions 24.

The signal transmission conductor set 3 is disposed between the first grounding base portion 12 and the second grounding base portion 14, and has a plurality of signal bended portions 34.

The second differential signal transmission conductor set 4 is disposed on the side of the second grounding base portion 14 deviating from the signal transmission conductor set 3, and has a plurality of second differential signal bended portions 44.

The power supply transmission conductor 5 is disposed on the side of the second differential signal transmission conductor set 4 deviating from the second grounding base portion 14. The power supply transmission conductor 5 defines a plate power supply contact portion 51 at the front end thereof, which is extended rearward with a power supply base portion 52. The power supply base portion 52 forms a grounding circuit together with the first grounding base portion 12 and the second grounding base portion 14, and the power supply base portion 52 and second grounding base portion 14 can restrain the common mode signal interference generated from the second differential signal transmission conductor set 4. Furthermore, the power supply transmission conduct 5 has a plurality of power supply bended portions 51, and the above-mentioned grounding bended portion 16, first differential signal bended portion 24, signal bended portion 34, second differential signal bended portion 44 and power supply bended portion 54 respectively has a bended angle ranging from 120 to 150 degrees, thereby guiding scattered radio frequency interference (RFI).

From the description mentioned above, the present invention has the following advantages comparing with the prior arts while putting into practice:

1. the present invention may use the same terminal set to apply on different USB connector patterns through the design of various soldering portions and base portions being positioned on the same plane.
2. the first, second grounding base portions 12, 14 of the grounding transmission conductor 1 surround the first, second differential signal transmission conductor sets 2, 4, the common mode signal interference generated from the first, second differential signal transmission conductor sets 2, 4 can be restrained.
3. the crosstalk generated from the first, second differential signal transmission conductor sets 2, 4 to the signal transmission conductor set 3 can be isolated through the first, second grounding base portions 12, 14.

We claim:

1. A USB plug connector structure, comprising:

a ground transmission conductor, defining a plate grounding contact portion at a front end thereof, said plate grounding contact portion being diverged rearward and extended with a respective first grounding base portion and a first grounding soldering portion extended from said first grounding base portion, said plate grounding contact portion being bended and extended in a direction deviating from said first grounding base portion to form a second grounding base portion parallel to said first grounding base portion, and said second grounding base portion being extended to define a second grounding soldering portion connected to said first grounding soldering portion;

a first differential signal transmission conductor set, disposed between said two first grounding base portions, said first differential signal transmission conductor set defining a first elastic differential signal contact set at a front end thereof, and said first elastic differential signal contact portion set being extended rearward with a first differential signal base portion set and a first differential signal soldering portion set extended from said first differential signal base portion set;

a signal transmission conductor set, disposed between said first grounding base portion and said second grounding base portion, a front end of said signal transmission conductor set defining a plate signal contact portion set, and said plate signal contact portion set being extended rearward with a signal base portion set and a signal soldering portion set extended from said signal base portion set;

a second differential signal transmission conductor set, disposed on a side of said second grounding base portion deviating from said signal transmission conductor set, said second differential signal transmission conductor set defining a second elastic differential signal contact portion set at a front end thereof, said second elastic differential signal contact portion set is extended rearward with a second differential signal base portion set and a second differential signal soldering portion set extended from said second differential signal base portion set;

a power supply transmission conductor, disposed on a side of said second differential signal transmission conductor set deviating from said second grounding base portion, a front end thereof defining a plate power supply contact portion, and said plate power supply contact portion being extended rearward with a power supply base portion and a power supply soldering portion extended from said power supply base portion;

an insulating colloid, formed with an accepting space for receiving an electronic module at a bottom thereof, having at least one stopping portion for limiting a position of said electronic module, said insulating colloid installing said grounding transmission conductor, first differential signal transmission conductor set, signal transmission conductor set, second differential signal transmission conductor set and power transmission conductor, and first differential signal contact portion set and second elastic differential signal contact portion set being at a space interval from said electronic module; and a shielding housing, covering said insulating colloid.

2. The structure according to claim 1, wherein said shielding housing covers said insulating colloid in a range not including said first grounding soldering portion, second grounding soldering portion, first differential signal soldering portion set, signal soldering portion set, second differential signal soldering portion set and power supply soldering portion.

3. The structure according to claim 1, wherein said shielding housing covers said insulating colloid in a range including said first grounding soldering portion, second grounding soldering portion, first differential signal soldering portion set, signal soldering portion set, second differential signal soldering portion set and power supply soldering portion, said first grounding soldering portion, second grounding soldering portion, first differential signal soldering portion set, signal soldering portion set, second differential signal soldering portion set and power supply soldering portion all soldered on said electronic module, said electronic module is covered by said shielding housing and said shielding housing is disposed with a rear cover at one end thereof.

4. The structure according to claim 1, wherein said shielding housing covers said insulating colloid in a range including said first grounding soldering portion, second grounding soldering portion, first differential signal soldering portion set, signal soldering portion set, second differential signal soldering portion set and power supply soldering portion, and an opening allowing a transmission wire to be passed through is formed on one end of said shielding housing.

5. A USB plug connector structure, comprising:

a grounding transmission conductor, defining a plate grounding contact portion at a front end thereof, said plate grounding contact portion being diverged rearward and extended with a respective first grounding base portion and a first grounding soldering portion extended from said first grounding base portion, said plate grounding contact portion being bended and extended in a direction deviating from said first grounding base portion to form a second grounding base portion parallel to said first grounding base portion, and said second grounding base portion being extended to define a second grounding soldering portion connected to said first grounding soldering portion;

a first differential signal transmission conductor set, disposed between said two first grounding base portions, said first differential signal transmission conductor set defining a first elastic differential signal contact set at a front end thereof, and said first elastic differential signal contact portion set being extended rearward with a first differential signal base portion set and a first differential signal soldering portion set extended from said first differential signal base portion set;

a signal transmission conductor set, disposed between said first grounding base portion and said second grounding base portion, a front end of said signal transmission conductor set defining a plate signal contact portion set, and said plate signal contact portion set being extended rearward with a signal base portion set and a signal soldering portion set extended from said signal base portion set;

a second differential signal transmission conductor set, disposed on a side of said second grounding base portion deviating from said signal transmission conductor set, said second differential signal transmission conductor set defining a second elastic differential signal contact portion set at a front end thereof, said second elastic differential signal contact portion set is extended rearward with a second differential signal base portion set and a second differential signal soldering portion set extended from said second differential signal base portion set;

a power supply transmission conductor, disposed on a side of said second differential signal transmission conductor set deviating from said second grounding base portion, a front end thereof defining a plate power supply contact portion, and said plate power supply contact portion being extended rearward with a power supply base portion and a power supply soldering portion extended from said power supply base portion, said power supply soldering portion, second differential signal soldering portion set, second grounding soldering portion, signal soldering portion set, first grounding soldering portion and first differential signal soldering portion set being arranged transversely parallel to one another on the same plane, and said power supply base portion, second differential signal base portion set, second grounding base portion, signal base portion set, first grounding base portion and first differential signal base portion set being arranged transversely parallel to one another on the same plane.

6. The structure according to claim 5, wherein said insulating colloid is covered with a shielding housing in a range not including said hollow portion, said first grounding soldering portion, second grounding soldering portion, first differential signal soldering portion set, signal soldering portion set, second differential signal soldering portion set and power supply soldering portion are all soldered on a circuit board, and said circuit board is not covered by said shielding housing.

7. The structure according to claim 5, wherein said grounding transmission conductor, first differential signal transmission conductor set, signal transmission conductor set, second differential signal transmission conductor set and power supply transmission conductor being respectively coupled to an insulating colloid, said insulating colloid having a hollow portion, and said hollow portion allows said first grounding soldering portion, second grounding soldering portion, first differential signal soldering portion set, signal soldering portion set, second differential signal soldering portion set and power supply soldering portion to be exposed to the outside.

8. The structure according to claim 7, wherein said insulating colloid is covered with a shielding housing in a range including said hollow portion, said first grounding soldering portion, second grounding soldering portion, first differential signal soldering portion set, signal soldering portion set, second differential signal soldering portion set and power supply soldering portion are all soldered on an electronic module, and said electronic module is covered by said shielding housing.

9. The structure according to claim 5, wherein said grounding transmission conductor, first differential signal transmission conductor set, signal transmission conductor set, second differential signal transmission conductor set and power supply transmission conductor being respectively coupled to an insulating colloid, said insulating colloid having a plurality of groove portions, and each said groove portion respectively allows said first grounding soldering portion, second grounding soldering portion, first differential signal soldering portion set, signal soldering portion set, second differential signal soldering portion set and power supply soldering portion to be exposed to the outside.

10. The structure according to claim 9, wherein said insulating colloid is covered with a shielding housing in a range including said groove portions, said first grounding soldering portion, second grounding soldering portion, first differential signal soldering portion set, signal soldering portion set, second differential signal soldering portion set and power supply soldering portion are respectively in electric connection with a transmission wire.

11. The structure according to claim 9, wherein said insulating colloid is is covered with a shielding housing in a range not including said groove portions, said first grounding soldering portion, second grounding soldering portion, first differential signal soldering portion set, signal soldering portion set, second differential signal soldering portion set and power supply soldering portion are respectively in electric connection with a transmission wire.

12. A USB plug connector structure, comprising:

a grounding transmission conductor, defining a plate grounding contact portion at a front end thereof, said plate grounding contact portion being diverged rearward and extended with a respective first grounding base portion, said plate grounding contact portion being bended and extended in a direction deviating from said first grounding base portion to form a second grounding base portion parallel to said first grounding base portion, and said grounding transmission conductor having a plurality of grounding bended portions;

a first differential signal transmission conductor set, disposed between said two first grounding base portions, said first differential signal transmission conductor set having a plurality of first differential signal bended portions;

a signal transmission conductor set, disposed between said first grounding base portion and said second grounding base portion, and said signal transmission conductor having a plurality of signal bended portions;

a second differential signal transmission conductor set, disposed on one side of said second grounding base portion deviating from said signal transmission conductor, and said second differential signal transmission conductor set having a plurality of second differential signal bended portions; and a power supply transmission conductor, disposed on one side of said second differential signal transmission conductor set deviating from said second grounding base portion, said power supply transmission conductor having a plurality of power supply bended portions, and said grounding bended portion, first differential signal bended portion, signal bended portion, second differential signal bended portion and power supply bended portion respectively having a bended angle ranging from 120 to 150 degrees, thereby guiding scattered radio frequency interference.

13. A USB plug connector structure, comprising:

a grounding transmission conductor, defining a plate grounding contact portion at a front end thereof, said plate grounding contact portion being diverged rearward and extended with a respective first grounding base portion, said first grounding base portions being allowed to isolate crosstalk interference generated from a first differential signal transmission conductor to a signal transmission conductor set, said plate grounding contact portion being bended and extended in a direction deviating from said first grounding base portion to form a second grounding base portion parallel to said first grounding base portion, said second grounding base portion being allowed to isolate crosstalk generated from a second differential signal transmission conductor set to signal transmission conductor set;

said first differential signal transmission conductor set, disposed between said two first grounding base portions;

said signal transmission conductor set, disposed between said first grounding base portion and said second grounding base portion;

said second differential signal transmission conductor set, disposed on one side of said second grounding base portion deviating from said signal transmission conductor set; and a power supply transmission conductor, disposed on one side of said second differential signal transmission conductor set deviating from said second grounding base portion.

14. A USB plug connector structure, comprising:

a grounding transmission conductor, defining a plate grounding contact portion at a front end thereof, said plate grounding contact portion being diverged rearward and extended with a respective first grounding base portion, said first grounding base portions being allowed to suppress common mode signal interference generated from a first differential signal transmission conductor set, and said plate grounding contact portion being bended and extended in a direction deviating from said first grounding base portion to form a second grounding base portion parallel to said first grounding base portion;

said first differential signal transmission conductor set, disposed between said two first grounding base portions;

a signal transmission conductor set, disposed between said first grounding base portion and said second grounding base portion;

a second differential signal transmission conductor set, disposed on one side of said second grounding base portion deviating from said signal transmission conductor set; and a power supply transmission conductor, disposed on one side of said second differential signal transmission conductor set deviating from said second grounding base portion; a front end thereof defining a plate power supply contact portion, said plate power supply contact portion being extended rearward with a power supply base portion, said power source base portion being formed into a grounding circuit with said first grounding base portion and said second grounding base portion, and said power supply base portion and said second grounding base portion are allowed to suppress common mode signal interference generated from said second differential signal transmission conductor set.

15. A USB plug connector structure, comprising:

a ground transmission conductor, defining a plate grounding contact portion at a front end thereof, said plate grounding contact portion being diverged rearward and extended with a respective first grounding base portion and a first grounding soldering portion extended from said first grounding base portion, said plate grounding contact portion being bended and extended in a direction deviating from said first grounding base portion to form a second grounding base portion parallel to said first grounding base portion, and said second grounding base portion being extended to define a second grounding soldering portion connected to said first grounding soldering portion;

a first differential signal transmission conductor set, disposed between said two first grounding base portions, said first differential signal transmission conductor set defining a first elastic differential signal contact set at a front end thereof, and said first elastic differential signal contact portion set being extended rearward with a first differential signal base portion set and a first differential signal soldering portion set extended from said first differential signal base portion set;

a signal transmission conductor set, disposed between said first grounding base portion and said second grounding base portion, a front end of said signal transmission conductor set defining a plate signal contact portion set, and said plate signal contact portion set being extended rearward with a signal base portion set and a signal soldering portion set extended from said signal base portion set;

a second differential signal transmission conductor set, disposed on a side of said second grounding base portion deviating from said signal transmission conductor set, said second differential signal transmission conductor set defining a second elastic differential signal contact portion set at a front end thereof, said second elastic differential signal contact portion set is extended rearward with a second differential signal base portion set and a second differential signal soldering portion set extended from said second differential signal base portion set;

a power supply transmission conductor, disposed on a side of said second differential signal transmission conductor set deviating from said second grounding base portion, a front end thereof defining a plate power supply contact portion, and said plate power supply contact portion being extended rearward with a power supply base portion and a power supply soldering portion extended from said power supply base portion;

an insulating colloid, adapted to install said grounding transmission conductor, first differential signal transmission conductor set, signal transmission conductor set, second differential signal transmission conductor and power supply transmission conductor, one side of said insulating colloid defining a plurality of position limiting grooves, each said position limiting groove being adapted to limit a position of at least one transmission wire, and each said transmission wire being respectively in electric connection with said first grounding soldering portion, second grounding soldering portion, first differential signal soldering portion set, second differential signal soldering portion set, signal soldering portion set and power supply soldering portion.

* * * * *